US006913501B2

(12) United States Patent
Hibino et al.

(10) Patent No.: US 6,913,501 B2
(45) Date of Patent: Jul. 5, 2005

(54) DISPLAY PANEL PRODUCTION METHOD

(75) Inventors: Junichi Hibino, Neyagawa (JP); Yoshiki Sasaki, Shijounawate (JP); Katsuyosi Yamashita, Katano (JP); Masafumi Okawa, Neyagawa (JP); Yasuo Takeuchi, Hirakata (JP); Mitsuhiro Otani, Sakai (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/423,219

(22) Filed: Apr. 25, 2003

(65) Prior Publication Data

US 2003/0201717 A1 Oct. 30, 2003

Related U.S. Application Data

(62) Division of application No. 09/824,466, filed on Apr. 2, 2001, now Pat. No. 6,614,184.

(30) Foreign Application Priority Data

Mar. 31, 2000 (JP) ..... 2000-097306

(51) Int. Cl.[7] ..... H01J 9/00; H01J 9/24; H01J 17/49

(52) U.S. Cl. ..... 445/24; 313/586

(58) Field of Search ..... 445/24, 26; 313/580–589

(56) References Cited

U.S. PATENT DOCUMENTS 6,097,149 A 8/2000 Miyaji et al. ..... 313/582
6,437,505 B1 * 8/2002 Baret et al. ..... 313/582
6,439,943 B1 * 8/2002 Aoki et al. ..... 445/24
6,457,408 B1 10/2002 Yanigisawa et al. ..... 313/310
6,522,072 B1 * 2/2003 Yura et al. ..... 313/582
2003/0034732 A1 * 2/2003 Aoki et al. ..... 445/24
2004/0121697 A1 * 6/2004 Kojima ..... 445/24

FOREIGN PATENT DOCUMENTS

JP 03020926 A * 1/1991 ..... H01J/9/02
JP 11329236 A * 11/1999 ..... H01J/9/227
JP 11-329236 2/2002

* cited by examiner

*Primary Examiner*—Joseph Williams
*Assistant Examiner*—Peter Macchiarolo

(57) ABSTRACT

The present invention has as its objective to provide a display panel with silver electrodes without yellowing, and a method of producing such a display panel. After patterning and applying silver paste to form display electrodes on a substrate, glass paste is applied to form the dielectric layer, covering the electrodes, and both layers are simultaneously baked. Glass frit contained in the silver paste is chosen to have a lower softening point than die glass contained in the glass paste, and the baking process is divided into a first step, in which the baking temperature is equal to or higher than the softening point of the glass frit but lower than the softening point of the glass, and a second step, in which the baking temperature is higher than the softening point of the glass. This process allows a display panel to be produced with fewer bakings and reduced yellowing.

9 Claims, 8 Drawing Sheets

DISPLAY PANEL PRODUCTION METHOD

CROSS-REFERENCE TO RELATED APPLICATIONS

This application is a divisional application of U.S. Ser. No. 09/824,466 filed on Apr. 2, 2001, now U.S. Pat. No. 6,614,184, titled "DISPLAY PANEL AND DISPLAY PANEL PRODUCTION METHOD," by inventors Hibino et al.

BACKGROUND OF THE INVENTION (1) Field of the Invention

The present invention relates to a display panel used for displaying images, such as for a computer or television, especially a display panel with silver electrodes formed on the panel surface, and to a production method for such a display panel.

(2) Description of Prior Art

In the field of image displays for computers, televisions and other devices, recently field emission display panels, plasma display panels (PDP) and other types of display panel have received increasing attention as devices that allow a large color image display in a thin package. The PDP especially, because of its excellent high speed response and wide viewing-angle characteristics, has become the object of-great activity, as companies and research institutions step up R&D efforts aimed at a mass market.

A PDP has a front glass substrate and a back glass substrate, separated by barrier ribs. A plurality of display electrodes are formed in a stripe pattern on the back of the front glass substrate (the side facing the back glass substrate), and a dielectric layer is formed covering the electrodes.

In a conventional PDP, the front glass substrate is made from a soda-lime-borosilicate glass sheet, and the display electrodes are Cr—Cu—Cr or silver, which are relatively easily formed.

A silver electrode can be formed by thin-film method, but the relatively low-cost thick-film method is used also. The first step in the thick-film method is to form a thick silver film in the shape of the electrode pattern, by applying a silver paste containing silver particles, glass frit, resin solvent and such to the front glass substrate by a screen printing process, or by affixing a film containing silver particles, glass frit, resin and such by a lamination process, for example. Patterning is followed by baking at over 500° C., in order to remove the resin contained in the paste or film and to fuse the silver particles and glass frit. Fusing of the fused silver particles raises their conductivity, and fusing of the glass frit affixes them to the front glass substrate.

After baking, the dielectric layer is formed. Powder from ground low-melting lead glass, resin, and solvent are mixed to form a past, which is applied by screen-printing or lamination to cover the silver electrodes. When the solvent has dried, the panel is baked at over 500° C. a second time. At high temperature, the resin in the paste is removed and the low-melting lead glass is fused, forming the dielectric layer.

By the same processes, electrodes and a dielectric layer are formed and affixed to the back glass substrate as well.

In a PDP which uses silver electrodes, silver is ionized in the baking process and diffused inside the glass substrate, by reactions such as ion exchange with sodium included in the glass (usually 2.5 wt % to 15 wt %). This diffusion of silver is thought to proceed in proportion to the temperature and duration of baking. The diffused silver is reduced inside the glass substrate, forming colloid and causing yellowing of the glass. Yellowing in the front glass substrate is especially problematic, as it can cause deterioration of the color temperature and loss of image quality.

To reduce yellowing, suppression of silver ion diffusion by lowering baking temperature has been considered, but decomposition of the resin and softening of the electrode and dielectric layer materials are also dependant on the baking temperature, making change difficult. Similarly, reduction of baking time has been considered also. However, by simply shortening the baking time, resin may be left in the electrodes and dielectric layer, and fusion in these parts may be insufficient, carrying the risk of reduced electrode conductivity and reduced dielectric layer insulation.

This yellowing phenomenon occurs not only in PDPs, but also in field emission display panels and other display panels which have thick-film silver electrodes formed on a glass substrate, creating high demand for technology to suppress yellowing.

SUMMARY OF THE INVENTION

The objective of the current invention is to provide a display panel with reduced yellowing of the glass substrates, and a production method for such a display panel.

In order to achieve the objective stated above, the display panel of the current invention includes a first panel, which has rows of electrodes covered by a dielectric layer, and a second panel, which is arranged parallel to the first panel and separated from it by barrier ribs. The first panel is made of a material which includes glass, and its electrodes are made of a material which includes silver. The display panel is characterized by a ratio of the concentration of diffused silver in the dielectric layer, measured in an area of the dielectric layer with a diameter of 5 $\mu$m centered 5 $\mu$m from the interface of the electrode and the dielectric layer, versus the concentration measured in an area of the glass substrate with a diameter of 5 $\mu$m centered 7.5 $\mu$m from the interface of the electrode and the substrate, that is 0.5 or less.

With such a display panel, diffusion of silver into the dielectric layer is low, indicating that degradation of the dielectric layer is suppressed and diffusion of silver into the glass substrate is also low, resulting in reduced yellowing.

When the first panel is the front panel, deterioration of the display's color temperature can be reduced also.

To reduce yellowing in the front panel, it is desirable for the concentration of silver in an area of the glass substrate with a diameter of 5 $\mu$m centered 7.5 $\mu$m from the interface of the electrode and the substrate to be 0.8 wt % or less.

It is also desirable for the concentration of silver in an area of the dielectric layer with a diameter of 5 $\mu$m centered 5 $\mu$m from the interface of the electrode and the substrate to be 0.4 wt % or less.

In order to achieve the objective stated above, the first panel is further characterized by a substrate containing glass and 2.5 wt % of sodium, as well as a ratio of the concentration of sodium in the glass substrate, measured in an area with a diameter of 5 $\mu$m centered 7.5 $\mu$m from the interface with the electrode, versus the concentration measured in an area of the opposite surface of the glass substrate with a diameter of 5 $\mu$m, that is 90% or more.

Silver is thought to cause ion exchange with sodium contained in the glass, so that if a high concentration of sodium remains in the glass after baking, it is inferred that silver diffusion into the dielectric layer is low. Consequently, dielectric breakdown of the dielectric layer is suppressed, silver diffusion into the glass substrate is small, and yellowing of the glass substrate is reduced.

Here, if the concentration of sodium in the first panel, measured in an area of the glass substrate with a diameter of 5 $\mu$m centered 3 $\mu$m from the side of the electrode and 3 $\mu$m from the interface of the electrode and the substrate, is kept to 0.25 wt % or less, then yellowing of the glass substrate will be limited.

Regarding the shape of the panels, it can be said that the substrate of the first panel is in direct contact with the rows of electrodes on it across the display area of the display panel.

The production method for the display panel according to the present invention is characterized by a panel forming step that involves creating silver electrodes on the substrate and forming a dielectric layer covering the electrodes. The panel forming step includes a first, a second and a third step. The first step involves forming a pattern layer on the substrate, using a first resin and a first glass material. The second step involves forming a coating layer, which covers the pattern layer formed in the first step, using a second resin and a second glass material. The third step involves simultaneous baking of the pattern layer and the coating layer. The third step involves a first, a second and a third step. In the first step, temperature is raised to begin decomposition of the first and second resin contained in the pattern layer and coating layer. In the second step, temperature is maintained above softening point of the first glass material but below softening point of the second glass material. In the third step, temperature is raised above softening point of the second glass material.

In the third step above, simultaneous baking of the pattern layer and the coating layer suppresses diffusion of silver into the substrate and the coating layer.

According to the above production method, gas emitted from the first dielectric glass during heating in the second step can pass through the second dielectric glass layer above, since the second layer is not yet softened. Therefore, bubbles are not trapped in the first dielectric glass layer, and providing a more dense silver electrode.

In the second step, it is also possible to maintain a temperature above the softening point of the first glass and below softening point of the second glass, by creating a period when the heat-up rate is slower than that of the first step.

Here in the third step, burn-off of the resin can be promoted by operating in low pressure, dry gas, or oxidizing gas environments, and silver oxidation can be suppressed by operating in a reductant gas environment.

The production method for the display panel according to the present invention is further characterized by a front panel forming step that involves creating silver electrodes on the front glass substrate and forming a dielectric layer covering the electrodes. The front panel forming step includes a first, a second and a third step. The first step involves forming a pattern layer on the front glass substrate, using silver, a first resin and a first glass material. The second step involves forming a coating layer, which covers the pattern layer formed in the first step, using a second resin and a second glass material. The third step involves simultaneous baking of the pattern layer and the coating layer.

By the method described above, simultaneous baking of the front panel allows for a reduction in baking time, resulting in reduced diffusion of silver into the substrate and allowing manufacture of a display panel with higher color temperature than by conventional methods.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

Figure 1:
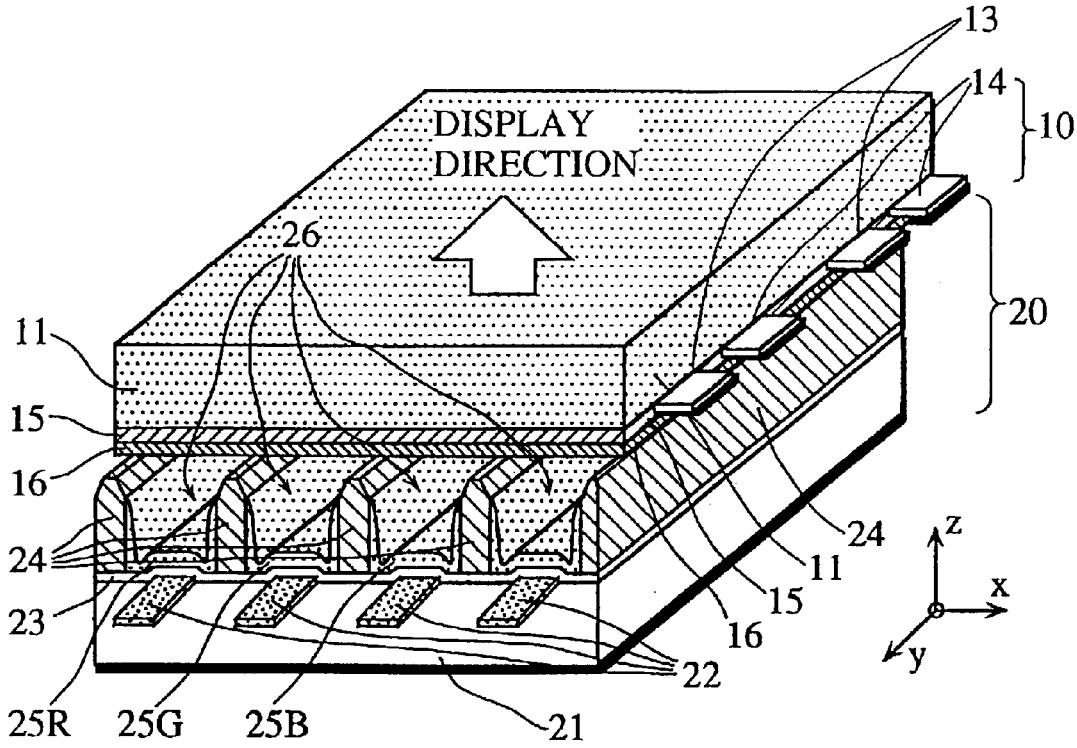
FIG. 1 is a simplified sectional perspective view of part of the PDP according to the present invention.

The following explains the preferred embodiment of the present invention as applied to a PDP, referring to the drawings.

Overall Construction of the PDP

Figure 2:
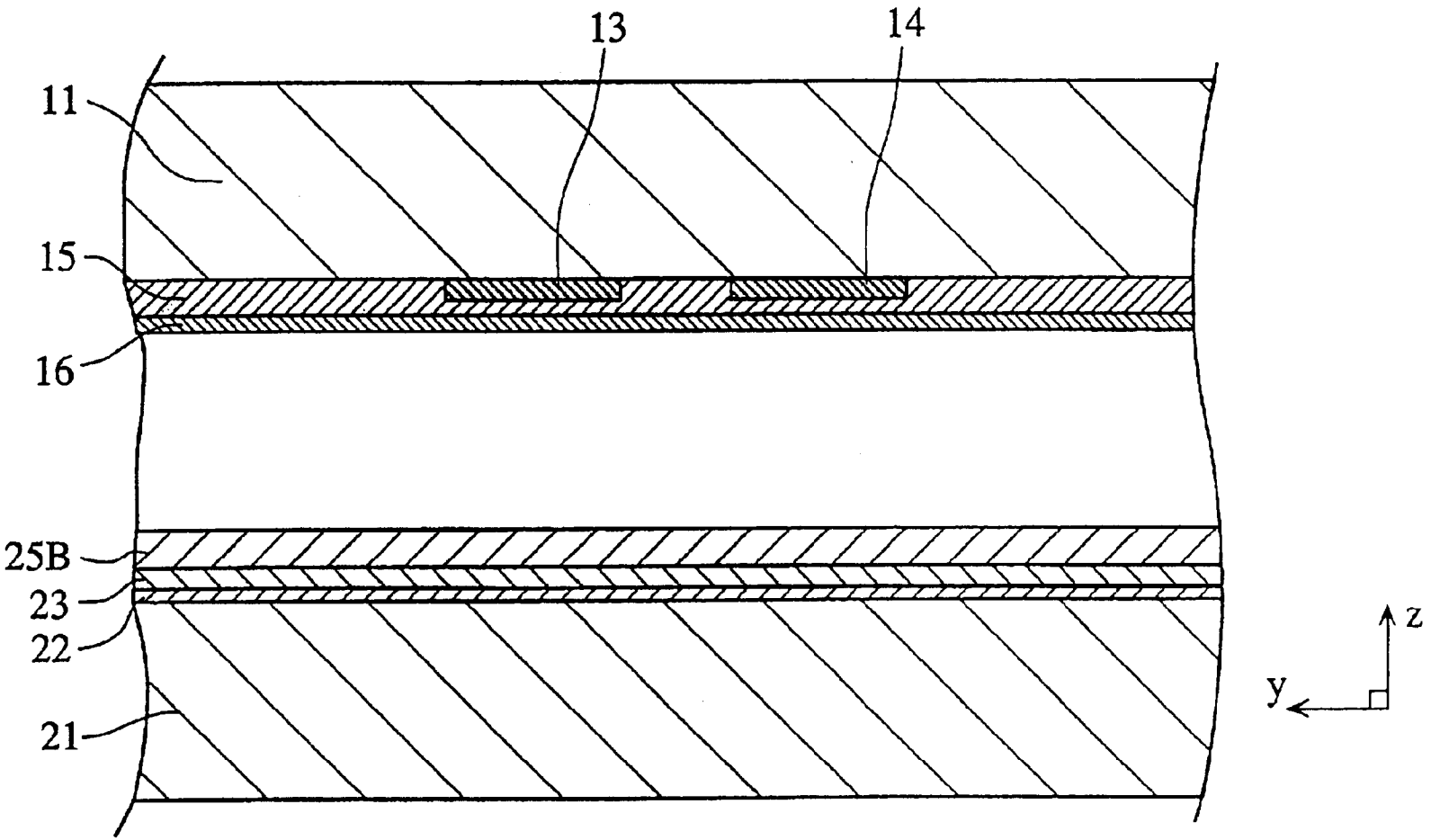
FIG. 2 is a magnified sectional view of a part of the PDP in FIG. 1, viewed along the x axis.

FIG. 1 is a sectional perspective view of part of the display area of a PDP according to the present invention, and FIG. 2 is a sectional view along the y-z axis of address electrode 17 in FIG. 1.

As shown in FIG. 1, a PDP is composed of a front panel 10, and a back panel 20, which face each other.

The front panel 10, has a front glass substrate 11, display electrodes 13 and 14, a dielectric layer 15, and a protective layer 16. On the opposite face from the front glass substrate 11 are a plurality of pairs of intersecting display electrodes 13 and 14. As shown in FIG. 2, the dielectric layer 15 and protective layer 16 are applied as coatings to cover each electrode surface.

The front glass substrate 11 is a planar sheet of soda-lime-borosilicate glass, which contains 2.5 wt % of sodium. There is no specified limit for the content of sodium, but up to 15 wt % is commercially available, so a higher content is desirable in consideration of cost.

The display electrodes 13 and 14 both have silver as their principal ingredient (herein, "principal ingredient" means the element composes at least 50 wt % of the body).

The dielectric layer 15 is formed as a coating over, and serves to insulate the display electrodes 13 and 14. The dielectric layer 15 is composed of a glass material, such as a lead-oxide glass compound of lead oxide, boric oxide, silicon oxide, and aluminum oxide, or a bismuth-oxide glass compound of bismuth oxide, zinc oxide, boric oxide, silicon oxide and calcium oxide.

The protective layer 16 is formed as a coating over the surface of the dielectric layer 15, and includes ingredients such as magnesium oxide (MgO).

As is explained below, the display electrodes 13 and 14 and the dielectric layer 15 are formed by simultaneous baking, resulting in reduced yellowing in the front glass substrate 11.

The back panel 20 is composed of the back glass substrate 21, address electrodes 22, a visible light reflecting layer 23, barrier ribs 24, and phosphor layers 25R, 25G and 25B.

The back glass substrate 21 is a planar sheet of soda-lime-borosilicate glass, similar to the front glass substrate 11, which contains 2.5 wt % of sodium. The back glass substrate 21 has address electrodes 22 arranged in a stripe pattern on the surface facing the front glass substrate 11.

The address electrodes 22, similar to the display electrodes 13 and 14 above, have silver as their principal ingredient, and are covered with a coating which forms the visible light reflecting layer 23.

The visible light reflecting layer 23 is a layer of dielectric glass, such as the dielectric layer 15 of the front glass substrate 11, with titanium oxide added. The visible light reflecting layer 23 combines the functions of reflecting visible light emitted from the phosphor layers 25R, 25B and 25G, and that of a dielectric layer.

The barrier ribs 24 are arranged in rows on the surface of the visible light reflecting layer 23, parallel to the address electrodes 22. Between the barrier ribs 24 are phosphor layers 25R, 25G and 25B, to which are applied phosphor particles, which emit red, green and blue light, respectively.

A PDP is composed of a front panel 10 and a back panel 20, which face each other and are sealed together around their perimeter by an airtight seal layer. The discharge space 26 created between the panels is filled with a discharge gas (such as a mixture of 95 vol % neon and 5 vol % xenon) at a certain pressure (such as 66.5 kPa).

Production Method

The PDP production method of the present invention is characterized by the baking process for the electrodes, dielectric layer and visible light reflecting layer of the front and back panels.

Below is an explanation of the baking process involved in a conventional PDP production method, followed by that of the present invention. The process for producing the electrodes and dielectric layer of the front panel is substantially similar to that of the electrodes and visible light reflecting layer of the back panel, so the front panel is taken as a representative example.

(1) Production Method of a Conventional Front Panel

Figure 3:
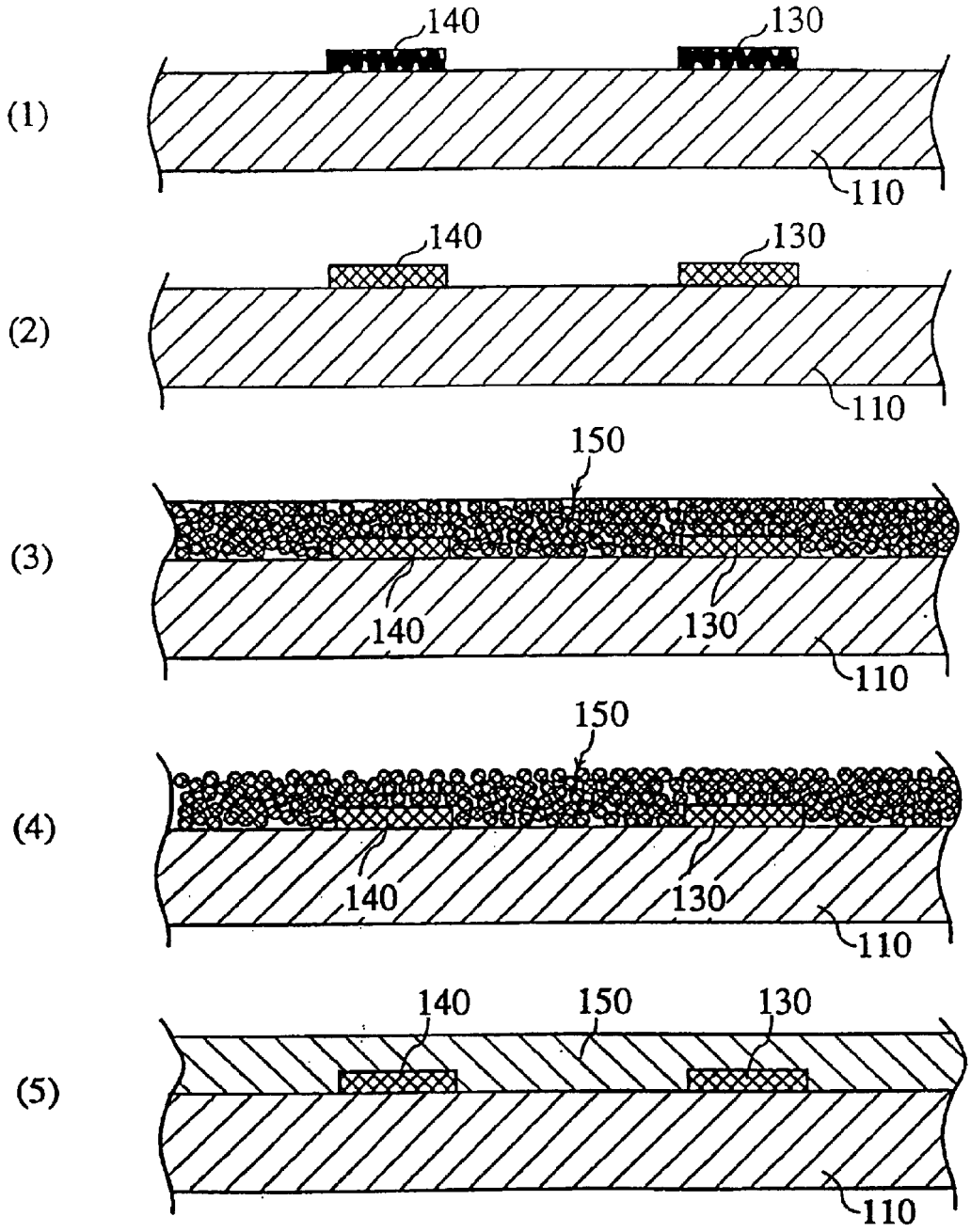
FIG.3 PRIOR ART
FIG. 3 is a diagram illustrating a conventional production process for forming a PDP front panel, progressing in steps from. (1) to (5)
Figure 4:
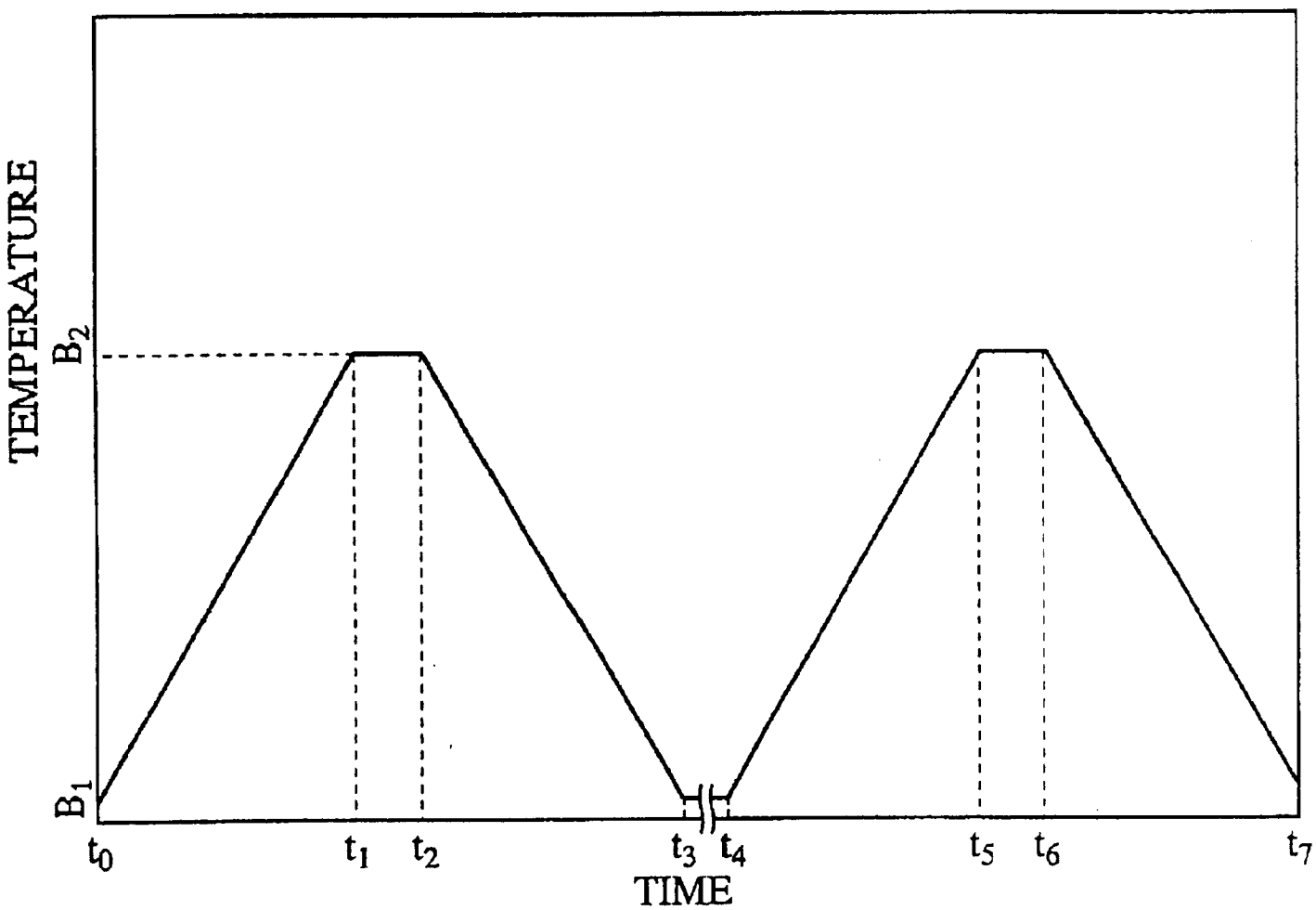
FIG. 4 is a graph showing the time-temperature relationship for a conventional baking process of a PDP front panel.

FIG. 3 (1) through (5) show a partial sectional view of a conventional front panel as it moves through the production process. FIG. 4 is a graph showing the relationship between temperature and time for baking a front panel.

(i) Formation of Display Electrodes 130 and 140

As shown in FIG. 3(1), silver paste, which has silver as its principal ingredient and also contains glass frit, resin and solvent, is patterned onto the front glass substrate 110 by a thick-film screen-printing method. After the solvent is dried, temperature is raised, as shown in FIG. 4. from ambient B1 to temperature B2 (e.g., 580° C.), which is equal to or higher than the softening point of the glass frit. This baking temperature is maintained at B2 for a given period (t1 to t2), to decompose the resin in the silver paste, fuse the silver and glass frit, and form the display electrodes 130 and 140. Then, to prevent cracking in the display electrodes and glass substrate, temperature is slowly lowered from B2 to Bi, from time t2 to t3.

During baking (time t0 to t3), ion exchange occurs at the interface the display electrodes 130 and the front glass substrate 110, between the silver contained in the display electrodes 130 and 140 and the sodium contained in the front glass substrate 110. Some of the silver ion is diffused into the front glass substrate 110.

(ii) Formation of the Dielectric Layer 150

Next, as shown in FIG. 3(3), a glass paste, containing a mixture of low-melting frit glass powder, binder resin and solvent, is applied by a thick-film screen-printing method to the front glass substrate 110 over the display electrodes 130 and 140. Drying of the solvent creates a coating of glass paste, as shown in FIG. 3(4), forming the dielectric layer 150.

Then, the front panel is heated again from ambient temperature B1 to equal to or higher than the softening point of the glass frit contained in the glass paste (e.g., 580° C., from t4 to t5), and maintained there for a given time (t5 to t6). As shown in FIG. 3(5), this baking decomposes the resin contained in the glass paste and fuses the glass frit. Then, to prevent cracking in the front glass substrate 110 and the display electrodes 130 and 140, temperature is slowly lowered (time t6 to t7), forming the dielectric layer 150. The protective layer is formed as a coating on the surface of the dielectric layer 150, completing the front panel.

During baking (time t4 to t7), ion exchange occurs between silver contained in the display electrodes 130 and 140 and sodium contained in the front glass substrate 110. More silver ion is diffused into the front glass substrate 110, and sodium ion is diffused into the dielectric layer 150 as well.

Compared to the above, a conventional back panel has address electrodes instead of the display electrodes 130 and 140, a visible light reflection layer instead of the dielectric layer 150, and barrier ribs and phosphor layers are formed. Otherwise, production is equivalent to the description above.

As described, conventional production of a front panel (or back panel) requires two bakings to form the display electrodes and the dielectric layer (or visible light reflection layer). This results in longer total baking time, and increased diffusion of silver (including silver ion) into the front (or back) glass substrate, in turn causing yellowing of the panel. Specifically, the concentration of diffused silver in a front glass substrate after two bakings, measured in an area of the substrate with a diameter of 5 $\mu$m centered 7.5 $\mu$m from the interface of the electrode and the substrate, is higher than 0.8 wt %, or approximately 0.88 wt %.

(2) Production Method of a Front Panel According to the Present Invention

The following is an explanation of the characteristics of the production method of a front panel according to the present invention, referring to the drawings.

Figure 5:
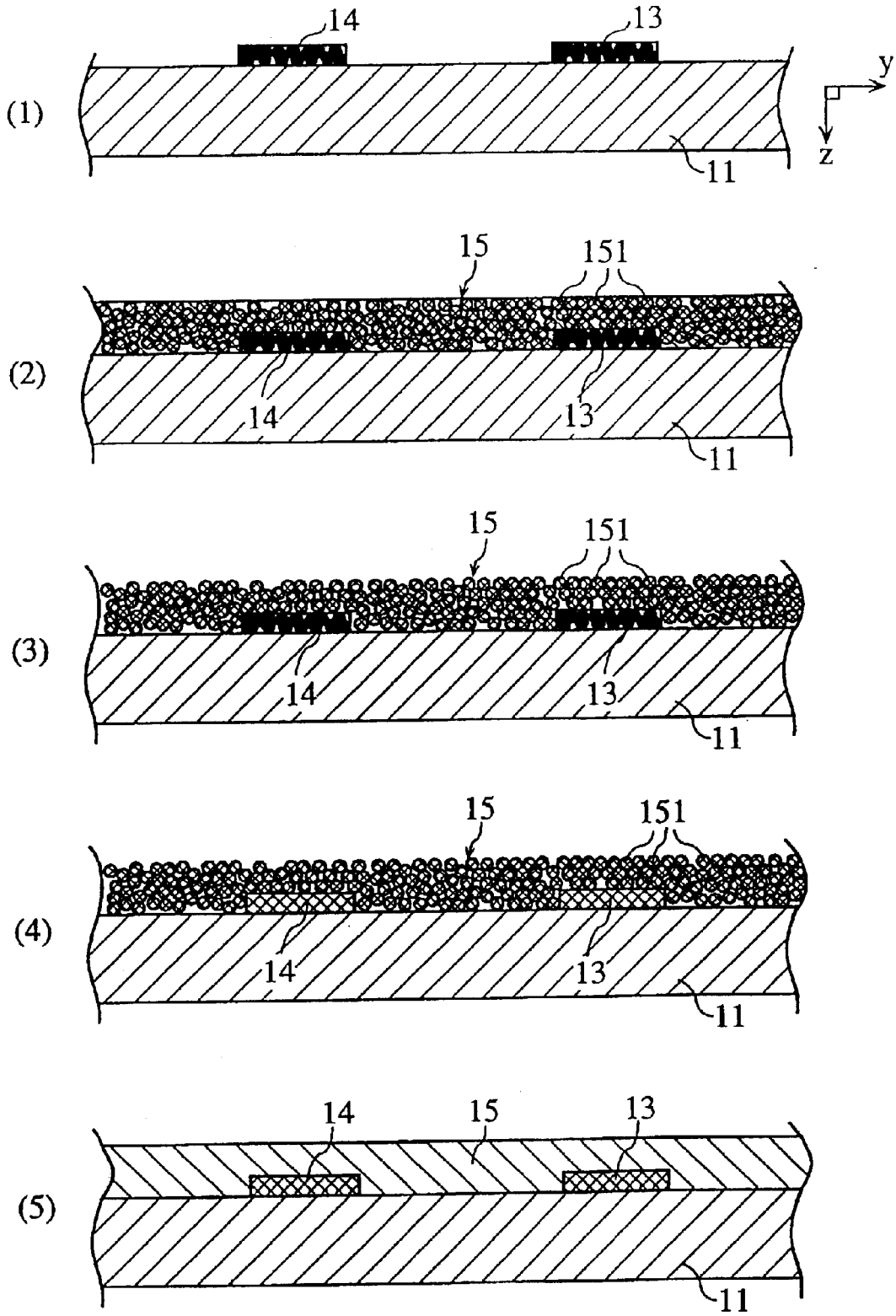
FIG. 5 is a diagram illustrating the production process for forming a PDP front panel according to the present invention, progressing in steps from (1) to (5)
Figure 6:
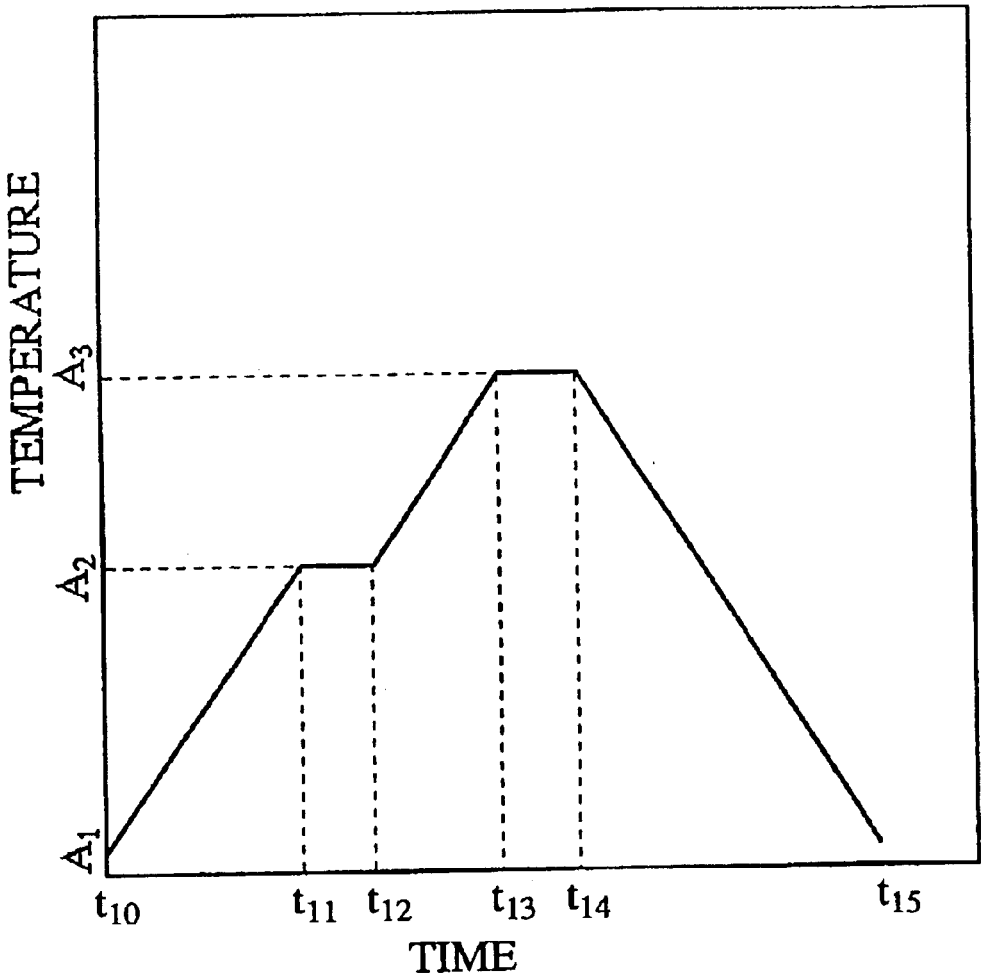
FIG. 6 is a graph showing the time-temperature relationship for the baking process of a PDP front panel according to the present invention.

FIG. 5(1) through (5) is a partial sectional view of a front panel as it moves through the production process according to the present invention. FIG. 6 is a graph showing the relationship between temperature and time for baking a front panel according to the present invention.

(i) Display Electrode Paste Application Process

As shown in FIG. 5(1), silver paste, which has silver as its principal ingredient and also contains glass frit, resin and solvent, is patterned onto the front glass substrate 11 by a thick-film screen-printing method and dried.

Here, it is desirable for the combined proportion of silver and glass frit to be at least 90 wt % of the silver paste. If the proportion is less than 90 wt %, the silver paste loses viscosity, and the desired shape may not be obtained when the paste is applied to the front glass substrate 11.

Further, a silver content in the paste of from 85 wt % to 95 wt % is desirable. Lower than 85 wt % creates increased shrinkage at baking, resulting in a less dense and less solid display electrode. A percentage higher than 95 wt % produces a higher viscosity silver paste, which creates inconsistencies in the thickness of the coating applied to the front panel 10, and an uneven electrode after baking.

It is desirable for the softening point of the glass frit to be in the range of 300° to 350° C. A lower softening point results in premature softening, hindering resin decomposition. A higher softening point may result in insufficient contact bonding between the display electrode and the front glass substrate. A proportion of 1 wt % to 10 wt % of glass frit in the paste is desirable. Glass frit content of less than 1 wt % results in reduced adhesion to the front glass substrate, while more than 10 wt % can hinder decomposition of resin in the paste at baking.

As for resin selection, a resin which is easily decomposed by baking, that is a resin which begins to decompose in air in the range of 350° to 500° C. is desirable, such as polymethyl methacrylate, ethyl cellulose, nitro cellulose, etc. Further, selection of a resin that completes decomposition at a lower temperature than the softening point of the glass in the dielectric layer 15 is desirable. This allows decomposition of the resin contained in the display electrodes 13 and 14 before fusing and hardening of the dielectric layer 15, preventing bubbles from being trapped in the electrodes.

It is desirable for the resin, in order to achieve the proper viscosity when the silver paste is applied, should be held within a range of 1 wt % to 10 wt % of the silver paste. When resin content is less than 1 wt %, the silver paste loses viscosity, and may cause difficulty in maintaining the desired electrode shape. When resin content is greater than 10 wt %, the silver paste becomes extremely viscous, and causes inconsistencies when applied to the glass substrate. The temperatures for starting and completing decomposition given above are values measured using a TG-DTA (thermogravimetric-differential thermal analysis) apparatus with a temperature-gain rate of 10° C. per minute.

For a solvent, an alcohol such as ethylene glycol, a terpene such as terpineol, a ketone such as methylethyl ketone, an ether such as carbitol, or other such compound is used.

It is desirable for the thermal coefficient of expansion of the compound of silver and glass frit in the silver paste to be within the range of $75\times10^{-7}$ /K to $85\times10^{-7}$ /K. This results in similar ranges for the display electrodes 13 and 14 and the front glass substrate 11, reducing stress at the interface of the display electrodes and substrate during baking, and thereby reducing flaking.

(ii) Dielectric Layer Application Process

Next, a thick-film screen-printing or a dye-coating technique is used to apply a glass material, composed of lead-oxide glass or bismuth-oxide glass, and glass paste, composed of resin and solvent, so as to cover the display electrodes 13 and 14 applied in the process above.

When selecting a glass material for the glass paste, it is desirable to select a compound which has a higher thermal coefficient of expansion than the compound of silver and glass frit used in formation of the display electrodes 13 and 14 above. The reason is to prevent formation of gaps at the interface between the display electrodes 13 and 14 and the dielectric layer 15, which may result from greater shrinkage of the dielectric layer 15 in the cooling process described below. Compared to the materials used in formation of the display electrodes 13 and 14, this glass material has a higher softening point than the glass frit used above, and the resin in the glass paste begins to decompose at a lower temperature.

After the glass paste which forms the dielectric layer 15 is applied to the front panel, a constant temperature dryer, or other device is used to vaporize the solvent contained in the paste.

(iii) Baking Process

Step 1: (time t10 to t11)

Next, after the solvent is vaporized, the front panel is placed in a baking furnace, and temperature is raised at a rate of from 5° to 20° C./minute to temperature A2, which is at least as high as the temperature at which the resin contained in the paste forming the display electrodes 13 and 14 and the dielectric layer 15 begins to decompose (about 200° C. for methyl meta-acrylate). When the resin contained in the silver paste and glass paste is vaporized, voids are formed between the glass particles 151 in the dielectric layer 15, as shown in FIG. 5(3).

Step 2: (Time t11 to t12)

After temperature A2 is reached, temperature rise is slowed to below 5° C./minute or stopped and held constant. Temperature is maintained in the range equal to or higher than the softening point of the glass frit contained in the silver paste and equal to or lower than the softening point of the glass material contained in the glass paste.

Resin in the silver paste and glass paste is completely decomposed, and the glass frit in the silver paste is fused to form the display electrodes 13 and 14, as shown in FIG. 5(4).

Here, as described above, when the decomposition temperature of the resin in the glass paste is lower than that of the resin in the silver paste forming the display electrodes 13 and 14, already at this point the resin in the glass paste is decomposed almost completely. The vaporized resin escapes through the voids between glass particles, and the supply of oxygen increases, aiding the decomposition process of the resin in the silver paste. Also, bubbles formed when the display electrodes 13 and 14 soften can pass through these voids and escape, reducing of air pockets in the finished electrodes. Therefore, the display electrodes 13 and 14 formed are dense and highly conductive.

In order to promote resin decomposition in Step 2, a reagent gas such as oxygen can be provided inside the baking furnace, which promotes oxidation of the resin. Providing a dry gas atmosphere accelerates baking by removing water produced by combustion of resin. Both techniques allow for more complete decomposition of the resin in the paste. At the same time, since metals such as silver oxidize easily, oxidation can be prevented by using hydrogen or another gas to create a reductant gas atmosphere in the baking furnace. Also, a low-pressure atmosphere can be created in the baking furnace to prevent formation of air pockets in the display electrodes 13 and 14, quickly removing from inside the furnace any gases emitted from the decomposing resin. It is desirable to maintain this low-pressure atmosphere continuously throughout Step 2, but even momentary imposition can reduce formation of air pockets.

Step 3: (Time t12 to t13)

When resin contained in the silver paste and glass paste is completely decomposed, temperature is again raised, to a temperature A3, equal to or higher than the softening point of the glass in the dielectric layer, at a given rate (e.g., 50 to 20° C./minute).

Step 4: (Time t13 to t14)

Next, rate of temperature rise is reduced to below that of Step 3, such as below 5° C./minute or stopped and held constant. Temperature is maintained in the range (temperature A3) equal to or higher than the softening point of the glass material contained in the glass paste. As shown in FIG. 5(5), this fuses the glass particles 151 contained in the glass paste, and results in the formation of a dielectric layer 15 with a dense structure.

Step 5: (Time t14 to t15)

Next, the hot front panel is cooled to ambient temperature. Cooling is done slowly, in order to prevent formation of cracks in the dielectric layer 15 and display electrodes 13 and 14.

Then, the front panel is removed from the baking furnace, and a protective layer is formed as a MgO coating applied over the dielectric layer 15 surface by CVD or other technique. This completes the formation of the front panel 10.

According to the production method described above, the front panel's electrodes and dielectric layer can be formed with only one baking. This shortening of baking time compared with conventional methods suppresses diffusion of silver into the front glass substrate, limiting concentration of diffused silver measured in an area of the glass substrate with a diameter of 5 μm centered 7.5 μm from the interface of the electrode and the substrate to 0.8 wt % or less, lower than that of panels produced by conventional methods.

(3) Production Method of a Back Panel

The following describes an example of a back panel 20 production method, referring to FIGS. 1 and 2.

The back panel 20 has address electrodes 22 formed in rows on the back glass substrate 21 by a screen printing technique using the same silver paste as the front panel electrodes. The visible light reflecting layer 23 is formed over the electrodes, also by a screen printing technique using the same glass paste as for the dielectric layer 15 above, with titanium oxide added. The address electrodes 22 and visible light reflecting layer 23 are baked by the same procedure as described above. Then a paste containing lead glass material is applied repeatedly at a given pitch by a screen printing technique and baked to form the barrier ribs 24. The discharge space 26 is divided into cells in the direction of the x-axis by the barrier ribs 24. Here, baking of the address electrodes 22 and visible light reflecting layer 23 may be done all at once after printing of the barrier ribs 24.

A phosphor ink paste, composed of red, green and blue phosphor particles and an organic binder, is applied in the channels formed between the barrier ribs 24. The organic binder is combusted, and the phosphor particles are fused to form the phosphor layers 25R, 25G and 25B.

(4) Fabrication of PDP by Assembly of the Panels

The front panel 10 and back panel 20 are joined so that the display electrodes 13 and 14 are perpendicular to the address electrodes 22. The panels are sealed together by a sealing glass material applied around their outer edges and baked about 450° C. for 10 to 20 minutes to form an airtight seal. The discharge space 26 is evacuated (e.g., to $1.1\times10^{-4}$Pa), then filled with a discharge gas (e.g., He—Xe- or Ne—Xe-type inert gas) at a given pressure to complete the PDP.

As stated above, using this method, the front panel 10 and back panel 20 can be produced with fewer bakings than by conventional methods, reducing the amount of silver diffused into the front glass substrate 11. As a result, yellowing and reduction of color balance in the finished PDP are controlled. Formation of air pockets in the display electrodes 13 and 14 is also controlled, providing display electrodes with a dense, fine texture and excellent conductivity. Reduction of repetitive baking also saves time and energy in the production process, allowing cost to reduced as well.

Experiment (1) Preferred Embodiment Sample

A PDP front panel was produced by the method disclosed above and shown in FIGS. 5 and. 6, as a sample of the preferred embodiment.

(2) Comparison Sample

A PDP front panel was produced by the method disclosed above and shown in FIGS. 3 and 4, as a sample of conventional methods for comparison.

(3) Experimental Procedure

Figure 7:
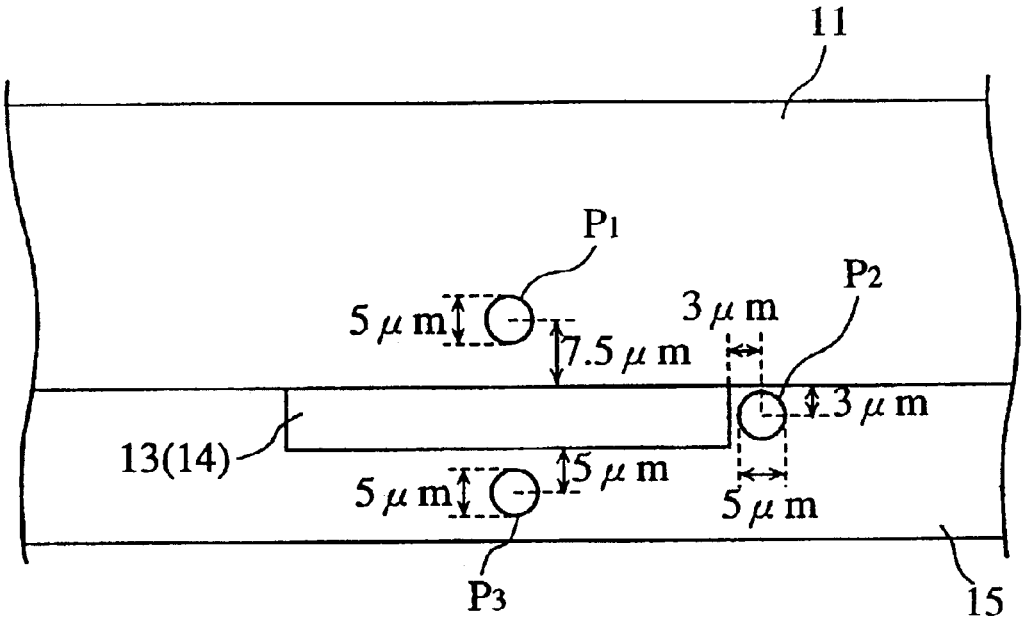
FIG. 7 is a magnified sectional view of part of a PDP, illustrating the specific locations for measuring silver and sodium content in the embodiment and the comparison samples.

The amounts of silver and sodium in the front glass substrate of the preferred embodiment sample and comparison sample were measured and compared. FIG. 7, a partial sectional view of a front panel, shows the locations where measurements were taken, specifically, in an area P1 of the front glass substrate 11 with a diameter of 5 μm centered 7.5 μm from the interface of a display electrode 13 (14) and the substrate.

In addition, measurements of silver and sodium were taken at P2, an area of the dielectric layer 15 with a diameter of 5 μm centered 3 μm from the side of the display electrode 13 (14) and 3 μm from the edge of the front glass substrate 11, and P3, an area of the dielectric layer 15 with a diameter of 5 μm centered 3 μm from the top of the display electrode 13 (14).

Further, as a base value, measurements of silver and sodium were taken at P1 of the front glass substrate before the front panel was formed.

(4) Experimental Conditions

Content of sodium in the front glass substrate used in the samples: 2.96 wt %

Instrument used for measurement: JEOL, Ltd. JXA-8900R Wavelength Dispersive X-ray Microanalyzer Acceleration voltage: 10 kV Illumination current: 40 nA Beam diameter: 5 μm Quantitative analysis of silver and sodium content was performed using the instrument above.

(4) Results and Observations

Experimental results are shown in Table 1.

As shown in the table, the content of diffused silver at P1 in the embodiment sample is 0.73 wt %, about 17% lower than the comparison sample measurement of 0.88 wt %. A lower value here is desirable as it means yellowing of the substrate is reduced. Whereas producing a value of 0.80 wt % or lower was difficult with conventional techniques, the embodiment of the current invention produces a value lower than 0.80 wt %. As silver is diffused into the front glass substrate, sodium moves from the front glass substrate into the dielectric layer by ion exchange. However, 2.70 wt % of sodium measured in the embodiment sample is only slightly less than the 2.96 wt % measured in the substrate before panel formation. Because it has been confirmed experimentally that almost no ion exchange occurs in the side of the substrate opposite from the electrodes, the concentration of sodium in the substrate before panel formation can be used as a representative for the concentration in the side of the front glass substrate opposite from the electrodes after formation of the panel.

At P2 and P3 also, the embodiment sample shows lower amounts of diffused silver and sodium than the comparison sample. In particular, 0.20 wt % of sodium at P2 of the embodiment sample is smaller than the 0.33 wt % measured in the comparison sample, indicating that silver and sodium ion exchange is suppressed in the embodiment sample. A lower value here is desirable as it means yellowing of the panel is reduced. Whereas producing a value of 0.25 wt % or lower was difficult with conventional techniques, the embodiment of the current invention produces a value lower than 0.25 wt %. At P3 also, the amount of diffused silver in the embodiment sample, 0.33 wt %, is lower than the comparison sample measurement of 0.48 wt %. A lower value here is desirable as it means yellowing of the panel is reduced. Whereas producing a value of 0.4 wt % or lower was difficult with conventional techniques, the embodiment of the current invention produces a value lower than 0.4 wt %.

Comparing the silver concentration at P3 and P1, the embodiment sample ratio of 0.45 is lower than the comparison sample ratio of 0.54. A value of 0.5 or lower here is desirable as it means panel yellowing and dielectric layer breakdown are limited. That is, by obtaining a value of 0.5 or lower, silver diffusion into the dielectric layer and yellowing of the panel are limited, and dielectric breakdown by diffusion of conductive silver into the dielectric layer can also be suppressed.

These results are due to reduced baking in the production method of the embodiment sample, which limits diffusion of silver into the front glass substrate (and sodium into the dielectric layer).

Modification Examples of the Preferred Embodiment (1) The preferred embodiment above has display electrodes formed in lines on the front glass substrate, but the present invention can also be embodied in a panel with electrodes of a different shape.

Figure 8:
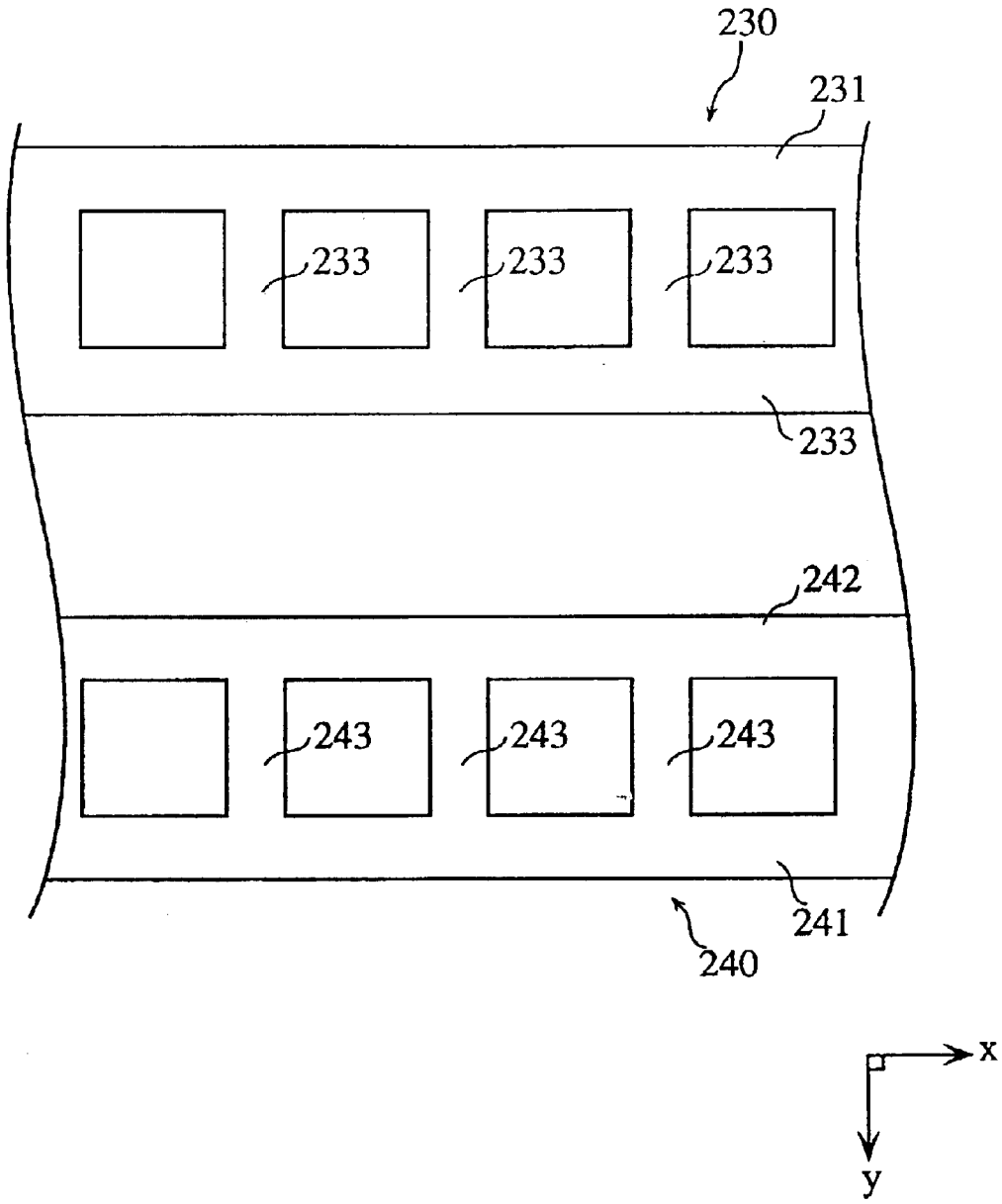
FIG. 8 is a play view illustrating part of the PDP front panel according to a modification of the preferred embodiment.

The PDP of this modification example has substantially the same structure as that of the preferred embodiment above, except for the display electrodes. As shown in FIG. 8, a plan view of the essential portion of the front panel, display electrodes 230 and 240 are arranged side by side in parallel to each other.

Display electrode 230 is composed of line units 231 and 232, which are spaced apart and parallel, connected by a plurality of bridge units 233 (this structure is referred to below as a "fence shape"). The display electrode 230 is in direct contact with the front glass substrate across the display area.

Display electrode 240 is composed of line units 241 and 242 and bridge units 243, structured in a fence shape like the display electrode 230.

Each display electrode 230 and 240 can be formed by the same method as the preferred embodiment above, using a screen-printing technique to apply silver paste to the front glass substrate in the fence shape.

By applying the production method of the preferred embodiment above, yellowing can be reduced in a PDP with fence-shaped electrodes as well.

(2) The preferred embodiment has been described using a PDP as an example, but other types of display panel which have silver electrodes composed of thick film formed on a glass substrate, such as a field emission display panel, can also utilize the present invention to reduce yellowing of the display panel's glass substrate.

Although the present invention has been fully described by way of examples with reference to the accompanying drawings, it is to be noted that various changes and modifications will be apparent to those skilled in the art. Therefore, unless such changes and modifications otherwise depart from the scope of the present invention, they should be construed as being included therein.

TABLE 1

| | Measured values (%) | | | | | | Ratio |
|---|---|---|---|---|---|---|---|
| | P1 | | P2 | | P3 | | P3/P1 |
| | Ag | Na | Ag | Na | Ag | Na | Ag |
| Embodiment | 0.70 | 2.71 | 0.19 | 0.19 | 0.36 | 0.09 | — |
| sample | 0.75 | 2.72 | 0.25 | 0.21 | 0.35 | 0.07 | — |
| | 0.73 | 2.67 | 0.29 | 0.23 | 0.28 | 0.08 | — |
| | — | — | 0.22 | 0.17 | 0.33 | 0.09 | — |
| average | 0.73 | 2.70 | 0.24 | 0.20 | 0.33 | 0.08 | 0.45 |
| Comparison | 0.91 | 2.33 | 0.30 | 0.30 | 0.50 | 0.07 | — |
| sample | 0.87 | 1.97 | 0.39 | 0.33 | 0.48 | 0.12 | — |
| | 0.87 | 2.14 | 0.30 | 0.29 | 0.42 | 0.07 | — |
| | — | — | 0.35 | 0.32 | 0.51 | 0.09 | — |
| average | 0.88 | 2.14 | 0.33 | 0.31 | 0.48 | 0.09 | 0.54 |
| Substrate | 0.0 | 2.96 | | | | | |
| before | 0.0 | 2.97 | | | | | |
| processing | 0.0 | 2.96 | | | | | |
| average | 0 | 2.96 | | | | | |

What is claimed is:

1. A display panel production method comprising a panel forming step, which allows creation of a silver electrode on a substrate, and formation of a dielectric layer covering the electrode, wherein the panel forming step includes:

a first step, for forming on the substrate a pattern layer containing silver, a first resin, and a first glass;

a second step, for forming a coating layer, which covers the pattern layer and contains a second resin and a second glass;

a third step, for simultaneously baking the pattern layer and the coating layer; wherein the third step includes:

a first substep, in which temperature is raised to equal or higher than decomposition point of the first and second resins contained in the pattern layer and coating layer;

a second substep, in which temperature is maintained at higher than or equal to softening point of the first glass but lower than softening point of the second glass; and a third substep, in which temperature is raised to equal or higher than softening point of the second glass.

2. The display panel production method of claim 1, wherein temperature in the second substep is maintained higher than or equal to the softening point of the first glass and below softening point of the second glass by creating a period when a rate of temperature rise is slower than a rate of temperature rise of the first substep.

3. The display panel production method of claim 1, wherein the third step is conducted in a low-pressure environment.

4. The display panel production method of claim 1, wherein the third step is conducted in a reductant gas environment.

5. The display panel production method of claim 1, wherein the third step is conducted in an oxidant gas environment.

6. The display panel production method of claim 1, wherein the third step is conducted in a dry gas environment.

7. The display panel production method of claim 1, wherein the third step is for forming the pattern layer directly on the front glass substrate.

8. The display panel production method of claim 1, wherein the display panel is a plasma display panel.

9. A method for producing display panels, comprising:

depositing a silver paste patterned as a plurality of electrodes on a first substrate;

covering the plurality of silver electrodes with a dielectric paste layer; and simultaneously baking the first substrate, the plurality of silver paste electrodes, and the dielectric paste layer in a single bake process which fuses the silver paste at a different temperature than the dielectric paste in order to reduce yellowing in the first substrate;

wherein the single bake process includes, raising the temperature to a first temperature equal to or higher than the decomposition point of the silver paste but lower than the softening point of the dielectric paste;

maintaining the first temperature until the silver paste is fused to form electrodes;

raising the temperature to a second temperature equal to or higher than the decomposition point of the dielectric paste; and maintaining the second temperature until the dielectric paste is fused to form a dielectric layer with a dense structure.

* * * * *

UNITED STATES PATENT AND TRADEMARK OFFICE

CERTIFICATE OF CORRECTION

PATENT NO. : 6,913,501 B2
APPLICATION NO. : 10/423219
DATED : July 5, 2005
INVENTOR(S) : Junichi Hibino et al.

It is certified that error appears in the above-identified patent and that said Letters Patent is hereby corrected as shown below:

On The Title Page (57)
In the Abstract:
In line 8 of the abstract, the word "die" should be --the--.

Signed and Sealed this

Twenty-second Day of May, 2007

JON W. DUDAS
*Director of the United States Patent and Trademark Office*